US007140714B2

(12) United States Patent
Lengyel

(10) Patent No.: US 7,140,714 B2
(45) Date of Patent: Nov. 28, 2006

(54) BACK-PRESSURE AND IMPEDANCE TESTER FOR INK JET CARTRIDGES

(75) Inventor: Dennis M. Lengyel, Hemlock, NY (US)

(73) Assignee: Nu-Kote International, Inc., Franklin, TN (US)

( * ) Notice: Subject to any disclaimer, the term of this patent is extended or adjusted under 35 U.S.C. 154(b) by 344 days.

(21) Appl. No.: 10/725,682

(22) Filed: Dec. 2, 2003

(65) Prior Publication Data

US 2005/0117004 A1 Jun. 2, 2005

(51) Int. Cl.
*B41J 29/393* (2006.01)
*B41J 1/19* (2006.01)

(52) U.S. Cl. ..... 347/19; 347/92

(58) Field of Classification Search ..... 347/5, 347/6, 7, 19, 30, 32, 85, 92
See application file for complete search history.

(56) References Cited

U.S. PATENT DOCUMENTS 4,240,082 A * 12/1980 Yu ..... 347/22
4,301,459 A * 11/1981 Isayama et al. ..... 347/19
5,075,689 A * 12/1991 Hoisington et al. ..... 347/41
5,485,187 A * 1/1996 Okamura et al. ..... 347/85
5,880,748 A * 3/1999 Childers et al. ..... 347/6
5,912,688 A * 6/1999 Gragg ..... 347/86
5,963,237 A * 10/1999 Ikkatai et al. ..... 347/85
6,007,193 A * 12/1999 Kashimura et al. ..... 347/92
6,059,405 A * 5/2000 Mochizuki et al. ..... 347/92
6,250,747 B1 * 6/2001 Hauck ..... 347/86
2004/0061747 A1 * 4/2004 Nakao et al. ..... 347/85

FOREIGN PATENT DOCUMENTS

JP 60024954 * 2/1985

* cited by examiner

*Primary Examiner*—Anh T. N. Vo
(74) *Attorney, Agent, or Firm*—Fay, Sharpe, Fagan, Minnich & McKee, LLP

(57) ABSTRACT

A flow resistance measuring or black-pressure tester is provided for ink cartridges. A syringe pump extracts fluid at a desired flow rate from an outlet port of an ink cartridge. An ink removal device allows a user to selectively purge air from the system to improve the accuracy of the meassurements. A variety of flow rates are measured to collect as benchmark data and allow new designs to be similarly sized, specified, and materials and pathways selected to control fluid delivery in replacement ink cartridges.

13 Claims, 1 Drawing Sheet

BACK-PRESSURE AND IMPEDANCE TESTER FOR INK JET CARTRIDGES

BACKGROUND OF THE INVENTION

This application relates to a testing system, and more particularly to a back-pressure and impedance tester for use with ink jet cartridges.

Ink jet printers have been commercially successful forms of printers that are used widely by individual consumers and business users. Typically, ink cartridges are selectively removed from a printer once they are spent or empty and replaced with a new cartridge, remanufactured cartridge, or the removed cartridge is refilled or replenished with ink. Consumers expect and printers require that the cartridges (new, remanufactured, or refilled) operate effectively with the printer. Thus, it is important that the installed ink cartridge exhibit similar fluid delivery characteristics when compared with the original ink cartridge so that the consumer does not encounter a different delivery of ink to the printer.

Heretofore, it has been very difficult to analyze the effects or changes made to fluid delivery systems without building and testing many sample ink cartridges. Such trials were time consuming and many times it is difficult to interpret the data. Such trials were necessary, however, to analyze the effect of component changes in the cartridge and how it impacted on fluid delivery, i.e., ink. Thus, a need has arisen to accurately measure the effect of component changes to a fluid delivery system. This, in turn, is expected to yield a cost and manpower savings if such trials can be conducted more efficiently.

Thus, not only is a reduced cost for a replacement ink cartridge required, but in addition the consumer wants to be assured that the replacement ink cartridge operates in substantially the same manner as that of the OEM product. After-market replacements have developed over the years for various ink cartridges. As a new style of cartridge enters the market, however, it is necessary for the remanufacturers to undertake a new round of testing and develop a data base of information relating to size, specification, materials, and fluid performance in order to control fluid delivery to the printer. This test data allows a quicker, more effective benchmarking of testing and developing ink jet cartridges.

SUMMARY OF THE INVENTION

An improved test and apparatus for measuring resistance to fluid flow or improved back-pressure testing is provided. The apparatus includes a fixture adapted to receive an associated ink cartridge. A sensor monitors the flow of ink through a fluid line from the associated ink cartridge to an ink removal device.

The sensor preferably includes a pressure transducer that sends data indicative of flow rates through the fluid line to a controller.

An air removal device, such as a syringe, is selectively connected to the fluid line to withdraw air from the system.

According to a preferred method of measuring impedance to flow, the cartridge is inserted into the fixture. Ink is then removed from an outlet portion of the ink cartridge to a fluid line, and flow through the fluid line is monitored with a pressure transducer. Data is then sent from the pressure transducer to a processor.

A primary benefit of the invention resides in the ability to accurately size, develop a specification, and choose both materials and fluid pathways to control fluid delivery in ink jet applications.

Another advantage of the invention resides in the ability to accurately measure the resistance to fluid flow in both open and closed fluid delivery systems.

Another advantage of the system resides in the improved sensitivity of the testing system, including the effective removal of air from the testing system and use of a pulseless pump for removing ink from the cartridge.

Yet another advantage of the system relates to studying and testing alternative replacement ink cartridge designs to maintain similar fluid impedance characteristics allowing for quicker development, and lower costs related to materials and testing.

Still other benefits and advantages of the invention will become apparent to those skilled in the art upon a reading and understanding of the following detailed description.

DETAILED DESCRIPTION OF THE INVENTION

Figure 1:
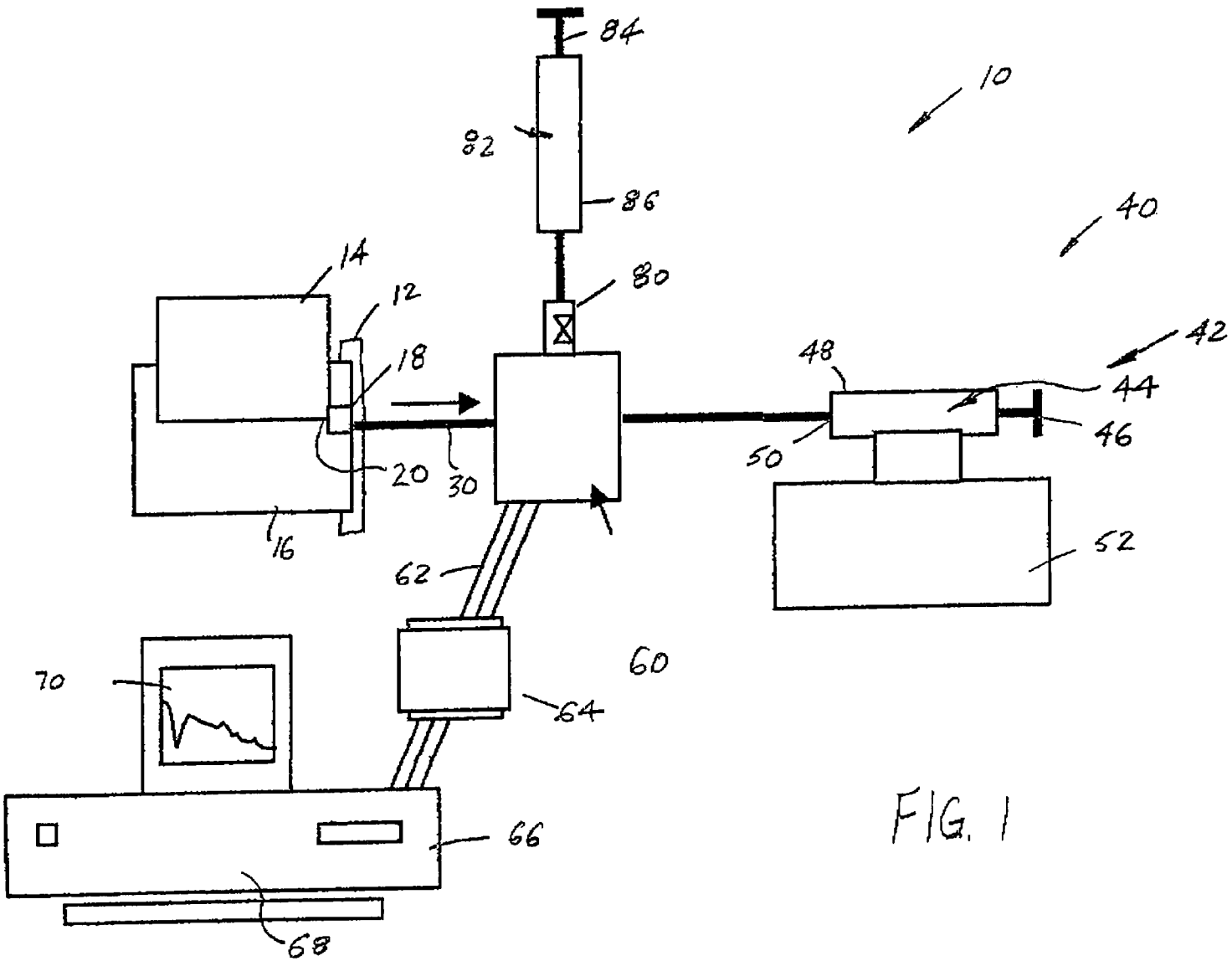
FIG. 1 is a schematic representation of the component elements of the testing system.

With reference to FIG. 1, a testing system 10 is schematically illustrated. In particular, the system includes a stand or fixture 12 adapted and dimensioned to receive an ink cartridge 14 therein. The fixture may include a modified printhead 16, although it is contemplated that the fixture includes an opening 18 that communicates with an outlet 20 of the ink cartridge, i.e., before the ink from the outlet reaches the printhead. In this manner, the small diameter nozzle openings of the typical printhead will not impact on the measurements of the ink impedance. Rather, remaining components of the ink cartridge can be effectively tested to collect data regarding OEM cartridges, as well as build and test alternative fluid delivery systems and materials in an effort to make compatible, accurate replacement ink cartridges.

Fluid line or passage 30 communicates with the cartridge opening 18 in the fixture and more importantly with the ink outlet 20 of the cartridge. The fluid line is in operative communication with an ink removal device 40. In this preferred arrangement, the ink removal device is a variable, pulseless pump such as pump 42, which in this instance is a syringe 44. The syringe 44 includes a plunger 46 having a piston (not shown) received in the housing 48 of the syringe. An opening 50 interconnects the fluid passage 30 with the syringe pump and an associated controller 52 provides an accurate withdrawal of ink from the cartridge, particularly providing fine controlled movement of the plunger and piston of the syringe. Prior arrangements have attempted to use different types of positive displacement pumps which ultimately resulted in pressure spikes being imposed on the testing system that adversely impacted on the collected data. By using a pulseless-type of pump such as the ink removal syringe 44, highly accurate measurements can be taken from the fluid line.

More particularly, a sensor 60 is operatively associated with the fluid line between the fixture and the pump assembly. The sensor is preferably a pressure transducer that monitors fluid line pressure and outputs an electronic data signal as represented by line 62 to a data acquisition board 64. The data acquisition board, in turn, communicates with a controller or computer 66 that includes associated analyzing software 68 loaded thereon for recording, storing, and manipulating the data from the sensor. A display or similar output device 70 of the computer allows the customized software to present the data analysis in a manner useful for gathering data regarding a particular ink cartridge.

A conventional pressure transducer is used and preferably is able to measure sensitivity in the range of millimeters, rather than feet. With the increased sensitivity, however, air is always a concern. Since air acts as a compressible medium that impacts on the ability to collect accurate data, it is important to be able to remove air from the system. Particularly, a three-way valve 80 is interposed between the sensor and a second syringe 82. The second syringe serves as an air removal device so that when the valve 80 communicates with the fluid line 30, air can be withdrawn from the system by selectively retracting plunger 84 relative to the housing 86 of the syringe. Once the air has been drawn from the sensor and/or fluid line, the three-way valve is closed to remove the air from the system and increase the sensitivity of the pressure transducer. In this manner, small pressure changes associated with flow through the fluid line 30 resulting from the syringe pump acting on the outlet for the ink cartridge provide accurate data through line 62 to the PC.

In operation, an ink cartridge is inserted into the fixture. Ink is then selectively removed at a desired rate by determining the withdrawal rate via the pump 42. Ink is removed from an outlet port of the ink cartridge, and flow through the fluid line 30 is monitored by the sensor. The pressure transducer provides a data signal indicative of flow through the line to the processor where the information is subsequently stored, analyzed, and/or displayed. The withdrawal of ink may be easily varied by altering the rate of movement of the plunger 46 of the syringe pump. Moreover, air and the compressible nature and adverse impact associated with attempting to develop accurate test data, is removed as a factor in the testing system. Particularly, the second syringe 82 selectively withdraws air from the arrangement when the valve 80 is opened to allow selective communication with the fluid line. Once the air is withdrawn, the valve is closed to maintain a high precision, accurate reading of the pressure/fluid flow through the passage 30.

The invention has been described with reference to the preferred embodiment and method. Obviously, modifications and alterations will occur to others upon reading and understanding the preceding detailed description. It is intended that the invention be construed as including all such modifications and alterations in so far as they come within the scope of the appended claims or the equivalents thereof.

Having thus described the present invention, it is now claimed:

1. An apparatus for measuring resistance to fluid flow from an associated ink cartridge comprising:

a fixture adapted to receive the associated ink cartridge therein;

an ink removal device operatively connected to the fixture through a fluid line for removing ink from the associated ink cartridge in a controlled manner;

a sensor monitoring flow to the ink removal device and forwarding data relating to such flow to a processor; and an air removal device selectively connected to the fluid line via a valve for removing air therefrom, wherein the valve is a three-way valve that is interconnected in the fluid line between the fixture and the ink removal device for selectively purging the fluid line of air.

2. The apparatus of claim 1 wherein the ink removal device is a first syringe.

3. The apparatus of claim 2 further comprising a syringe pump operatively connected to the first syringe for controlling movement of a plunger thereof and thereby controlling removal of ink from the associated ink cartridge.

4. The apparatus of claim 3 wherein the air removal device is a second syringe.

5. The apparatus of claim 2 wherein the air removal device Is a second syringe.

6. The apparatus of claim 1 wherein the air removal device is a second syringe.

7. The apparatus of claim 1 wherein the ink removal device is connected to an internal cavity of the associated ink cartridge through an outlet port thereof.

8. The apparatus of claim 1 wherein the ink removal device includes a variable, pulseless pump.

9. A method of measuring impedance to flow of ink from an ink cartridge with a testing system that includes a fixture for holding the ink cartridge, a pulseless pump operatively connected to the fixture via a fluid line, a sensor including a pressure transducer for monitoring fluid line pressure, and an air removal syringe operatively connected to the fluid line, the method comprising the steps of:

inserting an ink cartridge into a fixture;

removing ink from an outlet port of the ink cartridge through the fluid line;

monitoring the fluid line with the pressure transducer;

sending data from the pressure transducer representative of flow through the fluid line to a processor; and removing air from the testing system after the ink cartridge has been inserted into the fixture.

10. The method of claim 9 comprising the further step of varying a rate of ink removal from the ink cartridge.

11. The method of claim 9 including the step of developing fluid impedance characteristics of the ink cartridge based on the collected data.

12. A testing apparatus for measuring ink flow characteristics of a cartridge comprising:

a fixture dimensioned to receive an associated ink cartridge therein;

a fluid passage communicating with the fixture at an outlet of the associated ink cartridge;

a syringe pump operatively associated with the fluid passage for pumping ink from the associated cartridge at a selected flow rate;

an air removal syringe communicating with the fluid passage for withdrawing air from the system; and a pressure transducer monitoring flow through the fluid passage and providing data to a processor for storing and information relating to impedance characteristics of the cartridge.

13. The system of claim 12 further comprising a valve interposed between the air removal syringe and the fluid passage for selectively interconnecting the valve with the system.

* * * * *